US005452805A

United States Patent [19]

Robertson et al.

[11] Patent Number: 5,452,805

[45] Date of Patent: Sep. 26, 1995

[54] SPIRAL SEPARATOR

[75] Inventors: Michael D. Robertson, Jacksonville Beach; Frank S. Knoll, Jacksonville, both of Fla.

[73] Assignee: Carpco, Inc., Jacksonville, Fla.

[21] Appl. No.: 191,033

[22] Filed: Feb. 2, 1994

[51] Int. Cl.[6] ..... B07C 9/00

[52] U.S. Cl. ..... 209/697; 209/459

[58] Field of Search ..... 209/157, 724, 209/459, 500, 506, 494, 697, 434; 210/787, 788

[56] References Cited

U.S. PATENT DOCUMENTS

| | | | |
|---|---|---|---|
| 927,037 | 11/1910 | Pardee | 209/697 |
| 1,032,281 | 7/1912 | Hawley | 209/459 |
| 1,197,056 | 9/1916 | Pardee | 209/697 |
| 1,356,464 | 10/1920 | Pardee | 209/697 |
| 1,454,904 | 5/1923 | Pardee | 209/697 |
| 1,515,965 | 11/1924 | Pardee | 209/697 |
| 2,431,560 | 11/1947 | Humphreys | 209/459 X |
| 2,700,469 | 1/1955 | Humphreys | 209/459 X |
| 3,568,832 | 3/1971 | Persson | 209/459 |
| 4,189,378 | 2/1980 | Wright et al. | 209/459 |
| 5,184,731 | 2/1993 | Robertson et al. | 209/459 |

FOREIGN PATENT DOCUMENTS

| | | | |
|---|---|---|---|
| 222598 | 1/1958 | Australia | 209/459 |
| 53941 | 10/1974 | Australia | 209/434 |
| 299261 | 10/1971 | U.S.S.R. | 209/459 |
| 2098091 | 11/1982 | United Kingdom | 209/459 |

*Primary Examiner*—D. Glenn Dayoan
*Attorney, Agent, or Firm*—Arthur G. Yeager

[57] ABSTRACT

A spiral trough separator having a vertical axis and adapted to separate fine particles from a liquid slurry stream of those particles flowing down the spiral trough. The trough has spaced groups of parallel grooves, transverse to the flow of the slurry, a drain adjacent the lower ends of the grooves for collecting concentrates or fines of the particles and a wash liquid outlet to deliver liquid into the slurry stream to remove impurities from such fines prior to collection in the drain. The wash liquid outlet is adjustable with respect to the wash liquid flow in the wash liquid trough of the spiral to select the appropriate volume of wash liquid to be introduced into the liquid slurry stream.

17 Claims, 3 Drawing Sheets

SPIRAL SEPARATOR

BACKGROUND OF THE INVENTION

Vertical helical or spiral ore separators have been known for the use of concentrating heavy mineral particles and separating them from lighter rock particles. None of these provides a high quality separation due principally to the failure to agitate the slurry and its particles sufficiently to cause good lateral movement across the width of the slurry conduit perpendicular to the direction of travel of the slurry.

A recently issued U.S. Pat. No 5,184,731 discloses a spiral separator in which the concave surface of the helical trough is roughened by a pattern of spaced protuberances and/or a plurality of spaced spirally curved grooves converging from the outside perimeter toward the inside perimeter of the trough. The protuberances of this patent were to improve the separation by agitating the ore particles while the spiral converging channels were provided to direct the flow of the slurry and its ore particles toward the axis of the spiral separator.

It is an object of this invention to provide an improved helical ore separator. It is another object of this invention to provide an improved helical ore separator having an improved pattern of grooves for enhanced separation of certain types of slurries.

A further object is to provide drain passageways for fines of particles separated and directed thereto by the grooves and further enhanced by wash liquid flowing across the grooves to remove certain impurities from the fines of particles prior to collection thereof in the drain passageways. An additional object is the provision of selectively adjustable volume of wash liquid to enhance the removal of impurities from the fines to be collected

BRIEF SUMMARY OF THE INVENTION

This invention relates to an improved vertical axis spiral trough separator for separating solid particles from a liquid slurry of those particles in a liquid wherein the slurry is flowing down the trough having inside and outside perimeters and a concave surface therebetween. The improvement of this invention relates to a plurality of spaced groups of shallow parallel grooves in the concave surface, and positioned generally perpendicular to the inside and outside perimeters; preferably a plurality of drain passageways in the trough adjacently downstream of each group of grooves and positioned near the inside perimeter; and an outlet port adjacent the inside perimeter and upstream of each drain passageway for introducing wash liquid or water into the liquid slurry transverse of a group of grooves downstream from the outlet port, the volume flow of wash liquid entering the trough being manually adjustable.

In specific embodiments there are 2–4 groups of grooves per revolution of the spiral trough, each group containing 2–10 linear grooves 1–5 nm. deep and spaced 5–10 mm. apart. The drain passage is a hole in the trough with an upstanding flange to catch the flow approaching the drain and to direct it into the drain. The outlet port for wash liquid is manually movable to control the volume flow of wash liquid entering the inlet port and from the outlet port into the main stream of slurry flowing down the trough.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features and design details of the invention are best understood by reference to the attached drawings.

Figure 5:
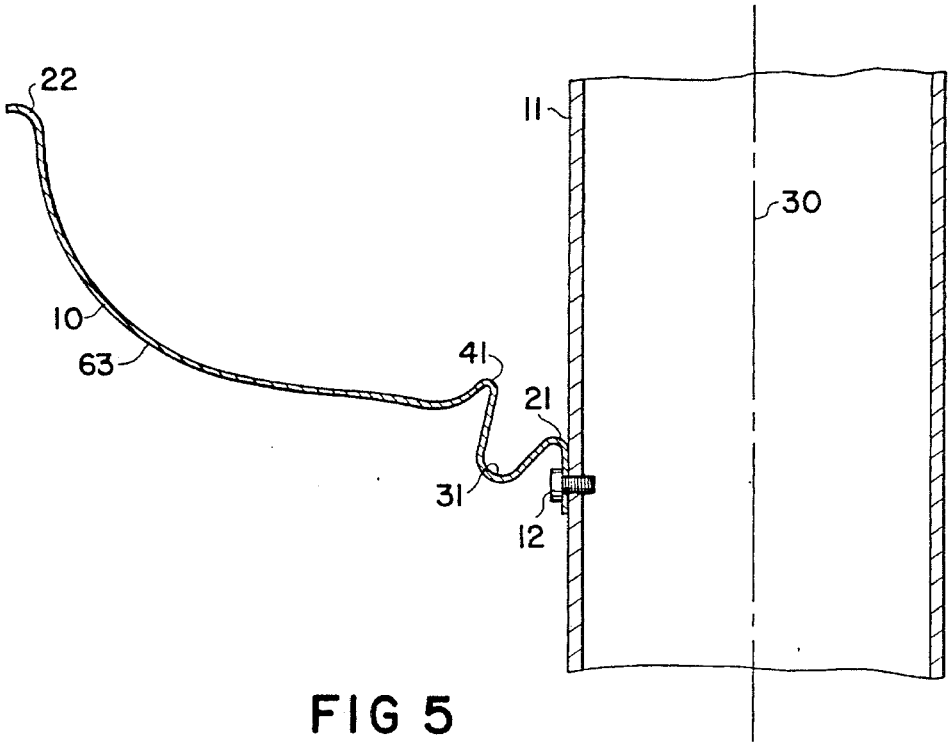
FIG. 5 is a cross-sectional view taken at 5—5 of FIG. 2.

In the drawings there may be seen the structure of the spiral separator of this invention. The separator basically is a trough 10 formed into a helical spiral and fastened to a central support shaft 11 by welding and/or bolts 12 to produce a rigid structure. A liquid slurry of solid particles is introduced into the trough in the direction of arrow 13 to flow down trough 10 as a helical stream of slurry and be discharged from trough 10 at the bottom in the direction of arrow 14. The size of helical spiral 10 may vary depending on the results to be accomplished. Generally there are 3–10 revolutions of the spiral in a single separator, the steepness of the spiral being determined by the speed of liquid flow desired, and the size of the trough in cross-section (as seen in FIG.5) being determined by the volume of flow to be handled.

Figure 2:
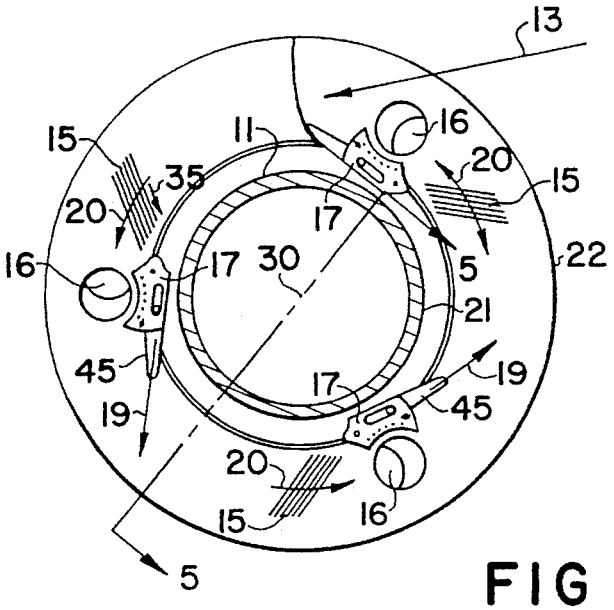
FIG. 2 is a top plan view of the spiral separator of this invention.
Figure 1:
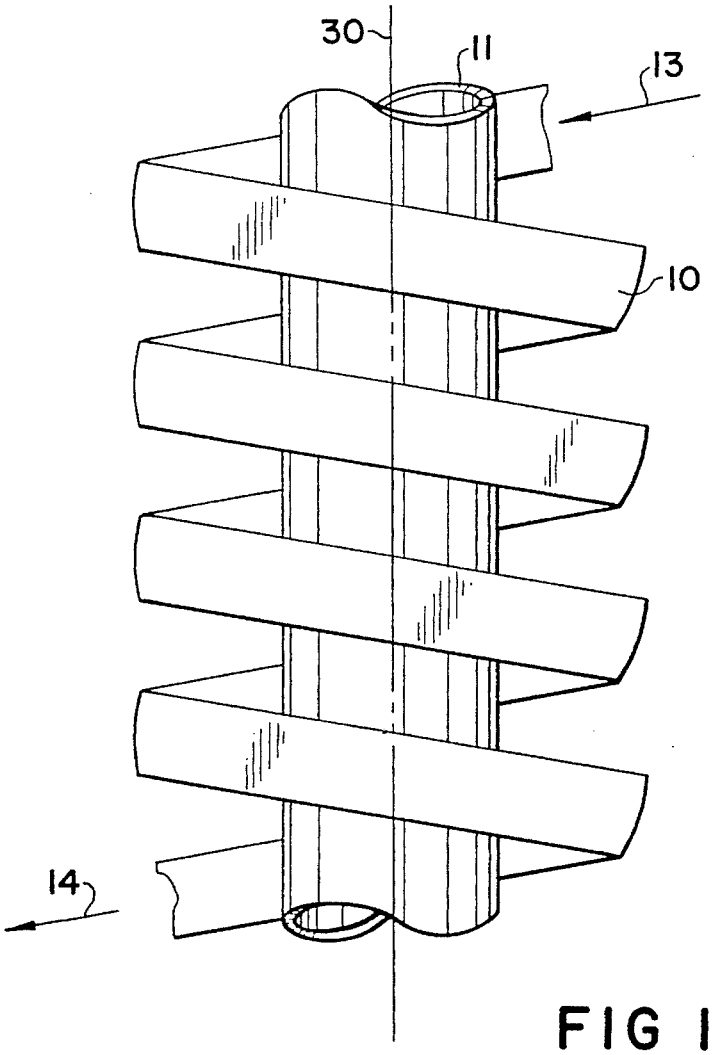
FIG. 1 is a front elevational view of the spiral separator of this invention.

In FIG. 2 there may be seen the placement of separation and recovery features. Spaced along the flow of the slurry are groups 15 of parallel grooves (seen more clearly in FIGS. 3–4), across which the slurry must flow in the direction of arrows 20. The groups 15 of grooves provide obstacles to the flow of particles along the bottom of the slurry stream 46 flowing on the concave surface of trough 10. Particles are caught by the group 15 of grooves which deflect the flow of particles in the direction of arrow 35 toward inner slurry barrier 41 and inner perimeter 21 of trough 10. Drain passageway 16 leads to a conduit to remove concentrates of particles in the liquid. Wash liquid is introduced at liquid outlet ports 60, shown by arrows 19, to displace undesirable particles from the concentrated slurry flow being directed to the drain passageways 16. This wash liquid is added through pipe outlets 60 directing liquid from spillways 45, as shown by arrows 19. Since the additional wash liquid flow may alter the desired flow characteristics in the main slurry stream 46, the liquid inlet means, in the form of pipes 37, are adjustable so as to provide more or less volume flow of wash liquid (i.e., free of particles) into the slurry stream 46. The number of drain passageways 16 and pipes 37 for flow of wash liquid 19 are selectively variable. Three groups 15 are shown in FIG. 2 with each group 15 of grooves having its own drain passageway 16, a housing 17 and an outlet flow of wash liquid 19. There may be systems in which there is only one drain passageway 16, and it is placed at the bottom of the spiral trough 10. There may be other arrangements which work more efficiently for other slurries. There may also be more pipe outlets 60 than there are drain passageways 16.

Figure 3:
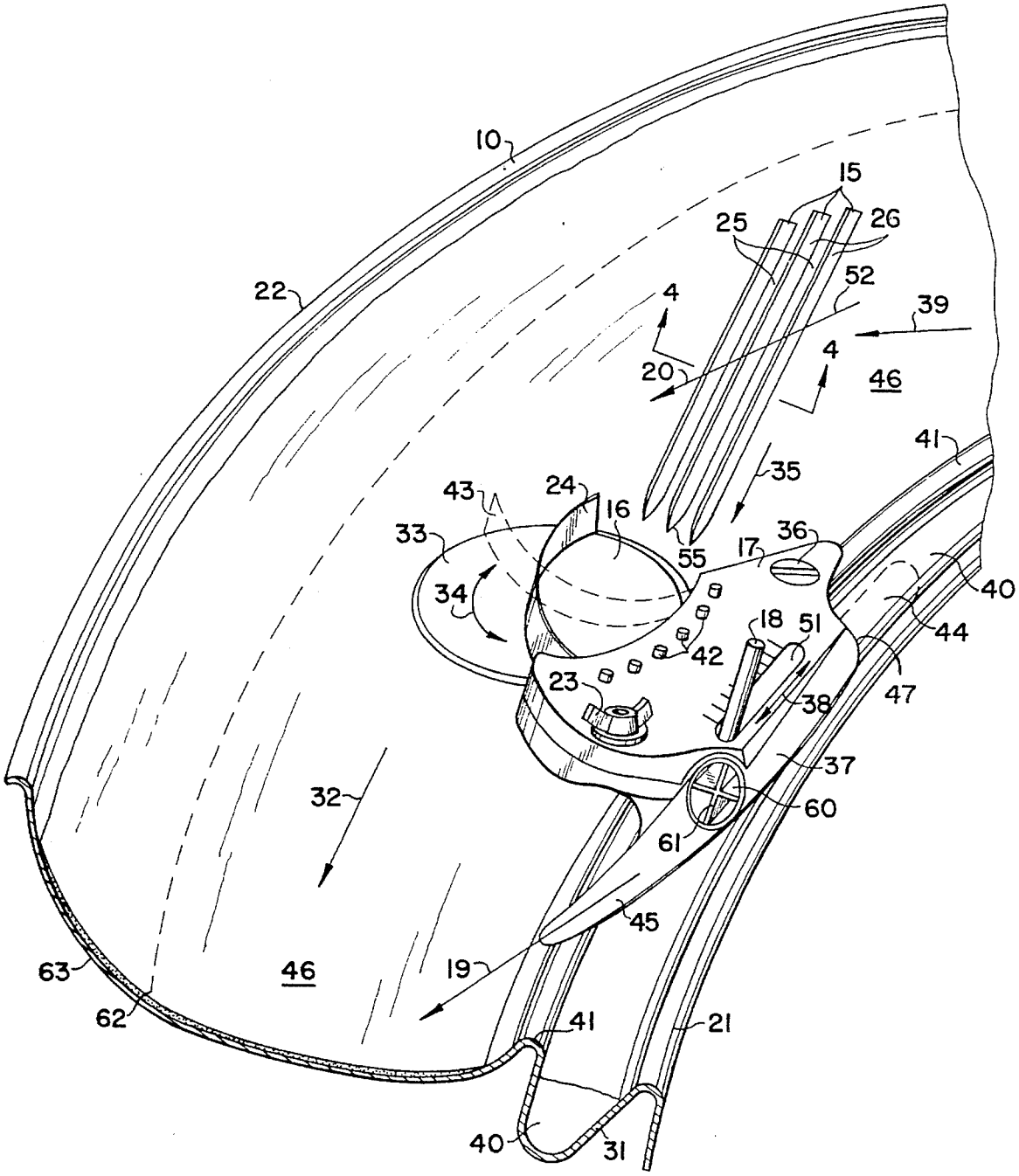
FIG. 3 is a partial perspective view of the spiral separator of this invention.

As shown in FIG. 3, a housing 17 is bolted to the helical trough 10 by means of screw or bolt 36 and wing nut 23. Housing 17 is placed along the inner slurry barrier 41 separating the concave surface of trough 10 from the wash liquid trough 31. Housing 17 frictionally holds a short section of pipe 37 at an inclined angle with respect to wash liquid trough 31 so that the pipe 37 shown by solid lines in FIG. 3, with its rear entrance end 47 to its rearward position where rear entrance end 47 is at broken line position 44. Pipe 37 is tilted such that as the rear entrance end 47 is moved from its full line position to broken line position 44 it dips below the surface of wash liquid stream 40 flowing in trough 31. The deeper rear entrance end 47 is in liquid stream 40, the more volume will flow out the front pipe outlet 60 and along the direction arrow 19 into the main slurry stream 46. Pipe 37 is movable by manually moving rod handle 18 forward or rearward in elongated slot 51. Housing 17 includes the elongated spillway 45 to direct the wash liquid into main stream 46 across the group 15 of grooves. Baffles 61 are generally indicated within pipes 37 to minimize any surging effects therein caused by the wash liquid flow in the trough.

Drain passageway 16 is fitted with a rotatable cap 33 which covers part of the open hole and supports a catch flange 24 which is upstanding and performs as a deflector to direct any liquid flowing into the flange 24 to pass into the drain passageway 16 and be carried away. Flange 24 may be rotated according to arrow 34 to permit flange 24 to catch more, as shown by broken line position 43, or less of stream 46 as it flows past. Pegs 42 are employed as index markers to assist in selectively adjusting the flanges 24 on several drains 16.

Figure 4:
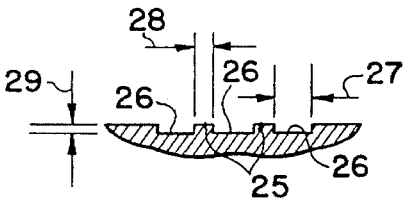
FIG. 4 is a cross-sectional view taken at 4—4 of FIG. 3.
Figure 6:
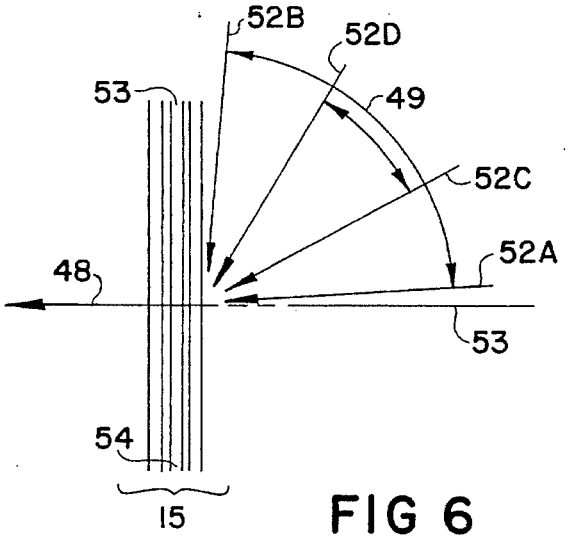
FIG. 6 is a perspective in a schematic illustration of the angle of attack between the slurry flow and the grooves.

FIG. 4 shows a cross-sectional view of grooves in a group 15. A preferred number of grooves is 2–4 in a single group 15. The depth 29 of each groove is preferably related to the size of particles to be separated from the slurry, the depth being 3–10 times the diameter of the particles, which, in most instances translates to a depth of about 1–10 mm. The grooves are about 1–15 mm. wide separated by lands about 5–20 mm. wide. Preferably grooves are 5–10 mm. wide and lands are 10–20 mm. wide. Grooves extend lengthwise across the flowing slurry stream 46 and at an angle to the flowing stream. The separation of particles is best when that angle is not 90° but is smaller, e.g., 5°–85° and preferably 30°–60° as may be seen in FIG. 6. If 52 is the direction of flowing stream 46, the grooves (group 15) should be set at an angle of 5°–85° (angle 49), preferably 30°–60° (angle 50). This means that the direction of attack of stream 46 should not be along arrow 53 (which is 90°) but may be any direction between arrows 52A and 52B (5°–85°) and preferably between arrows 52C and 52D (30°–60°). The angle of attack is such that the upstream end 54 of the grooves is near the base 62 of the spiral highwall 63 and the downstream end 55 of the grooves is adjacent inner slurry barrier 41 and near inside perimeter 21, upstream and downstream being identified based on the flow of particles in the grooves in the direction of arrow 35.

The number of groups 15 of grooves in the spiral trough 10 preferably is about 2–4 per revolution of the spiral trough 10. Three groups 15 of grooves are shown in FIG. 2 in a single revolution of helical trough 10, which is a most preferred arrangement.

The spiral separator of this invention is particularly useful in separating ore particles from an aqueous slurry of crushed ore.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a vertical axis enlarged spiral trough separator for separating solid particles from a slurry stream of particles in a liquid, the slurry stream flowing down said trough having inside and outside spiral perimeters and a concave surface therebetween, the improvement which comprises a plurality of spaced groups of shallow, parallel grooves per revolution of said spiral trough positioned transversely across the slurry stream, said grooves being positioned at an angle to the flow of said slurry, said angle being 5 degrees to 85 degrees from a perpendicular to said grooves, and directed from adjacent said outside perimeter toward said inside perimeter and terminating spacedly from said inside perimeter, a plurality of spaced means for admitting wash liquid to said trough at locations between adjacent said groups of grooves and near said inside perimeter.

2. The spiral trough separator of claim 1 wherein the depth of said grooves is 3–10 times the diameter of the particles being separated.

3. The spiral trough separator of claim 2 wherein said depth is 1–10 mm and the width of each groove is 1–15 mm.

4. The spiral trough separator of claim 2 wherein each said groove is spaced 5–20 mm from an adjacent said groove.

5. The spiral trough separator of claim 1 wherein said grooves are positioned at an angle to the flow of said slurry, said angle being 5°–85° from a perpendicular to said grooves, and directed from adjacent said outside perimeter toward said inside perimeter and terminating spacedly from said inside perimeter.

6. The spiral trough separator of claim 1 which additionally comprises a plurality of spaced drains for conducting a slurry of concentrated said particles away from said trough, each said drain being located adjacent said inside perimeter and adjacently downstream of one of said groups of grooves.

7. The spiral trough separator of claim 1 wherein the number of grooves per group is 2–10.

8. The spiral trough separator of claim 1 which additionally includes a small spiral trough adjacent said inside perimeter for conducting a supply of the wash liquid alongside said enlarged spiral trough, said means including an elongated pipe having an entrance and outlet ends for conducting the wash liquid from said small trough into said entrance end through said pipe to an outlet end facing toward the liquid slurry stream and generally toward one said group of grooves downstream therefrom, said pipe being longitudinally movable causing said entrance end of said pipe to receive a selected amount of the wash liquid from said small trough.

9. The spiral trough separator of claim 8 wherein said means further includes an upstanding rod rigidly connected to said pipe for manipulation of said pipe longitudinally to adjust the volume of wash liquid directed into the slurry stream.

10. The spiral trough separator of claim 8 wherein said pipe is positioned at an angle with respect to said concave surface such that movement of said pipe toward its said entrance end locates same deeper within said small spiral trough whereby a greater flow of wash liquid enters said entrance end.

11. The spiral trough separator of claim 8 wherein said means further includes an elongated spillway between said pipe outlet end and said concave surface for minimizing excessive turbulence of the wash liquid as it enters the slurry stream.

12. A vertical axis spiral trough separator having 3–10 revolutions about said axis for separating fine and larger particles from a liquid slurry of the particles and liquid flowing down said spiral, said separator including a liquid slurry trough having an internal concave surface between an inside perimeter near said axis and an outside perimeter spaced radially outward from said inside perimeter, a wash liquid trough located adjacent said inside perimeter and adapted to carry wash liquid adjacent said liquid slurry trough, said concave surface having a plurality of spaced groups of grooves throughout a substantial portion of the length of said liquid slurry trough, each said group having 2–10 spaced, parallel, grooves positioned at an angle of 5 degrees to 85 degrees to the flow of slurry therein, each groove being 1–5 mm deep and spaced 5–20 mm from the next adjacent groove, a particle collecting passageway through said trough and positioned adjacently downstream of each said group of grooves and adjacent said inside perimeter, and a plurality of spaced means for conducting wash liquid from said wash liquid trough into said liquid slurry trough from a position downstream of said passageway and adjacent said inside perimeter.

13. The separator of claim 12 wherein said means includes an elongated pipe linearly movable to selected positions having an outlet end and an entrance end located in said wash liquid trough, said pipe being longitudinally slidable to submerge said entrance end at selected depths in the wash liquid in said wash liquid trough.

14. The separator of claim 12 wherein each said group includes 3–5 grooves 1–5 mm deep.

15. The separator of claim 12 which includes 2–4 said groups per 360° revolution of said spiral trough.

16. The separator of claim 12 wherein the longitudinal direction of said grooves is positioned at an angle of 30°–60° to the flow of the liquid slurry with the downstream end of said grooves being adjacent to said inside perimeter and the upstream end of said grooves being spaced from said outside perimeter.

17. In a vertical axis enlarged spiral trough separator for separating solid particles from a slurry stream of particles in a liquid, the slurry stream flowing down said trough having inside and outside spiral perimeters and a concave surface therebetween, the improvement which comprises a plurality of spaced adjustable means for admitting wash liquid to said trough at spaced locations along said trough adjacent said inside perimeter, said means being selectively adjustable to provide variable volumes of the liquid directed into the slurry stream, a small spiral trough adjacent said inside perimeter for conducting a supply of the wash liquid alongside said enlarged spiral trough, said adjustable means including an elongated pipe having an entrance and outlet ends for conducting the liquid from said small trough into said entrance end through said pipe to an outlet end facing toward the liquid slurry stream, said pipe being longitudinally movable causing said entrance end of said pipe to receive a selected amount of the wash liquid from said small trough, including an upstanding rod rigidly connected to said pipe for manipulation of said pipe longitudinally, said pipe being positioned at an angle with respect to said concave surface such that movement of said pipe toward its said entrance end locates same deeper within said small spiral trough whereby a greater flow of wash liquid enters said entrance end.

* * * * *